US005224371A

United States Patent [19]

Vierto

[11] Patent Number: 5,224,371

[45] Date of Patent: Jul. 6, 1993

[54] APPARATUS FOR THE STRAIGHTENING OF VEHICLES

[76] Inventor: Raine Vierto, Viertola, 03320 Selki, Finland

[21] Appl. No.: 770,346

[22] Filed: Oct. 3, 1991

[51] Int. Cl.[5] ..... B21D 1/12

[52] U.S. Cl. ..... 72/447; 72/705

[58] Field of Search ..... 72/447, 705, 457

[56] References Cited

U.S. PATENT DOCUMENTS

| | | | |
|---|---|---|---|
| 3,340,720 | 9/1967 | Carter . | |
| 3,888,100 | 6/1975 | Chisum | 72/705 |
| 4,555,926 | 12/1985 | Moschlin et al. | 72/447 |
| 4,574,613 | 3/1986 | Doughty | 72/705 |

FOREIGN PATENT DOCUMENTS

| | | |
|---|---|---|
| 53930 | 9/1978 | Finland . |
| 59348 | 8/1981 | Finland . |
| 1414883 | 9/1965 | France . |
| 2102094 | 4/1972 | France . |
| 149834 | 3/1984 | Norway . |
| 7109114 | 7/1971 | Switzerland . |

*Primary Examiner*—Lowell A. Larson
*Attorney, Agent, or Firm*—Barnes & Thornburg

[57] ABSTRACT

Apparatus for the straightening of vehicles, comprising a straightening bench for the vehicle and a vertical beam with a cylindrical body (1) having a piston part (2) movable inside it. The apparatus comprises a mounting base (9) fitted to the upper end (8) of the piston part (2) and moving along with it. Attached to the mounting base is a lifting beam (10) for producing the lift required in the straightening operation.

18 Claims, 4 Drawing Sheets

APPARATUS FOR THE STRAIGHTENING OF VEHICLES

BACKGROUND & SUMMARY OF THE INVENTION

The present invention relates to a vehicle straightening apparatus comprising a cylindrical body with a piston part movable therein.

At present, the equipment used for the straightening of vehicle bodies comprises a straightening bench provided with body clamps, e.g., for the fastening to a car. Moreover, the equipment comprises lifting means for raising the straightening bench to a suitable working height. In some cases, the straightening apparatus includes a vertical draw beam with a cylindrical body and a piston part moving inside it. Straightening in the lateral direction can be achieved by fastening a chain which passes around a chain wheel attached to the cylinder body and around the upper end of the piston part to the area to be straightened. By raising the piston part, e.g., hydraulically, the chain is caused to draw the vehicle body area to be straightened in the desired lateral direction towards the draw beam.

The object of the present invention is to improve the operation of straightening equipment as described above and to achieve a straightening apparatus that is also capable of vertical straightening.

An object of the invention is obtained by having a mounting base for the lifting beam attached to the piston movable in the cylindrical body.

Additionally, the length of the lifting beam can be made adjustable in a stepless fashion by a second piston cylinder arrangement therein, independent of the height adjustment of the lifting beam.

An adjustable chain mechanism is provided for drawing of the vehicle beam by passing the chain around flanges on the lifting beam at the upper end of the piston on the cylindrical body.

It is also desirable to have an additional strengthening means at the free end of the lifting beam as well as a lock for fixing the length of the lifting beam.

The draw beam of the invention allows, e.g., the top of a vehicle to be straightened in a considerably faster and simpler manner than is possible with the currently known straightening equipment.

In the following, the invention is described in greater detail by the aid of examples by referring to the attached drawings, in which

DETAILED DESCRIPTION OF THE DRAWINGS

Figure 1A:
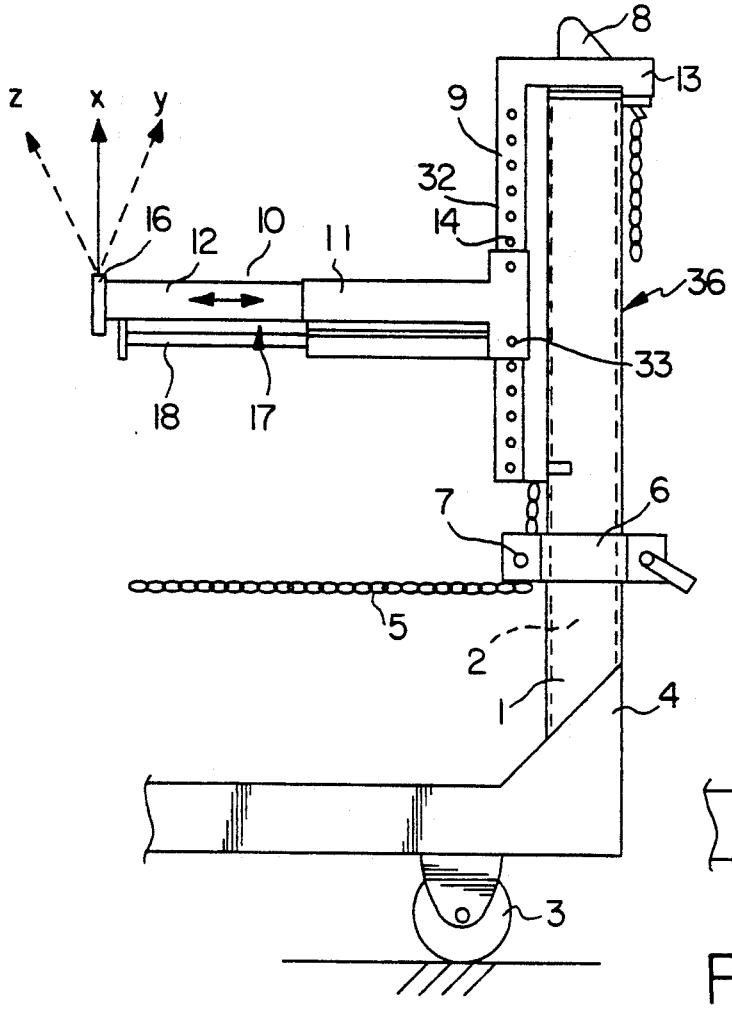
FIGS. 1*a* and 1*b* present the straightening apparatus of the invention in a lateral and rear view, respectively.

FIG. 1*a* represents the apparatus of the invention for the straightening of vehicle bodies. The apparatus is provided with a vertical draw beam 36 consisting of a cylindrical body 1 and a piston part 2, hydraulically movable within the body. The draw beam 36 is mounted on a base 4 provided with wheels 3. The base 4 can be fastened to a straightening bench (not shown) provided with body clamps. The apparatus is provided with a chain 5 to allow for lateral draw in the direction towards the lifting column. The chain 5 passes around a chain wheel 6 attached to a collar 7 (mounted on the cylinder body) and further around the top 8 of the piston part so as to allow vertical adjustment. The piston part 2 can be raised by means of a hydraulic unit to cause the chain 5 to be pulled through the collar 7 to draw the vehicle body area to be straightened (not shown) in the desired lateral direction towards the draw beam.

Figure 1B:
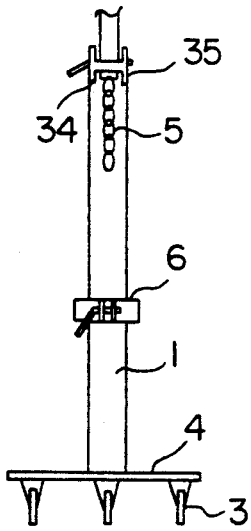

To allow for vertical lifting, the apparatus is provided with a horizontal lifting beam 10 attached to a mounting base 9 fitted to the upper end 8 of the piston part 2. The lifting beam 10 is of an adjustable length and comprises a cylindrical body 11 attached to the mounting base 9 and a second piston part 12 movable inside the cylindrical beam as indicated by the arrow. The upper end 13 of the mounting base 9 is formed in the shape of an inverted letter U so that it can be firmly fitted on the top 8 of the piston part 2. The lower end of the U-shank on the opposite side of the lifting beam can be provided with a pin (not shown) passing through holes so as to prevent the mounting base 9 from being lifted off its place. For rough vertical adjustment of the lifting beam 10, the vertical part 32 of the mounting base 9 is provided with holes 14 in which the lifting beam 10 can be secured by pins 33 passing through corresponding holes 15 in its body part. The end 16 of the piston part 12 can be provided with a suitable straightening accessory as required in each case as will be explained below. FIG. 1*b* shows that the mounting base 9 is provided with two flange-like edges 34, 35 at its upper end 13 for accommodating a chain 5 and also the top 8 of the piston part 2 between them as shown in FIG. 1*a*.

The primary function of the lifting beam 10 is to produce a lifting motion either vertically or in a direction slightly deviating from the vertical as indicated by the arrows x, y, z in FIG. 1*a*. During this vertical motion, it is also possible to perform normal drawing by means of the chain 5 shown in FIG. 1*a*. The motion of the second piston part 12 of the lifting beam can be produced by means of an auxiliary hydraulic cylinder 17 and its piston part 18 mounted under or inside the lifting beam. The movement actuator could be pneumatic or mechanical. This arrangement allows the vertical motion during the lifting operation to be controlled in the direction of the lifting beam 10 in relation to the draw beam 36 as required by the lifting/straightening operation in each case.

Figure 2A:
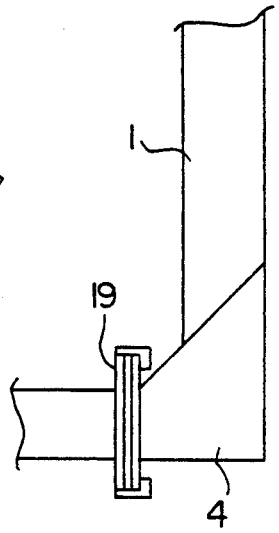
FIGS. 2*a* and 2*b* present a modification of the apparatus of FIGS. 1*a* and 1*b* wherein a jointed draw beam is shown in lateral and rear view, respectively.
Figure 2B:
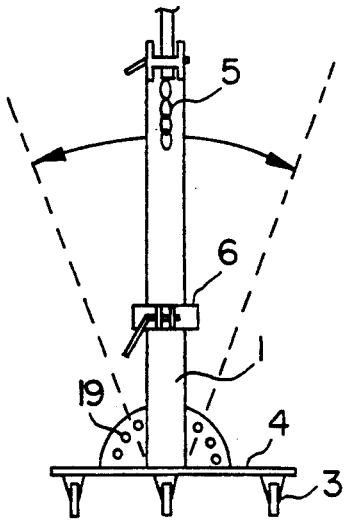

The draw beam 36 can also be mounted on a base 4 as shown in FIG. 2*a* and 2*b* by means of a rotating joint 19 provided in the base 4 so as to allow rotation of the draw beam 36 in a direction perpendicular to the direction of draw. With such an arrangement, the direction of the lifting motion can be adjusted in the directions indicated by the arrows before the lifting is started. In this case, simultaneous drawing by means of the chain 5 is possible.

Figure 3:
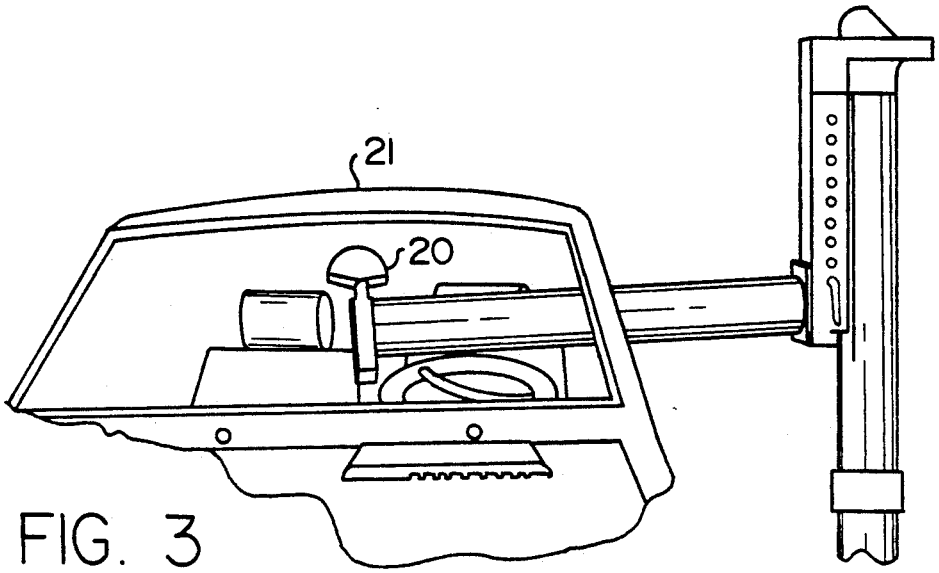
FIG. 3 illustrates the act of straightening the top of a car using the straightening apparatus of the invention.
Figure 4:
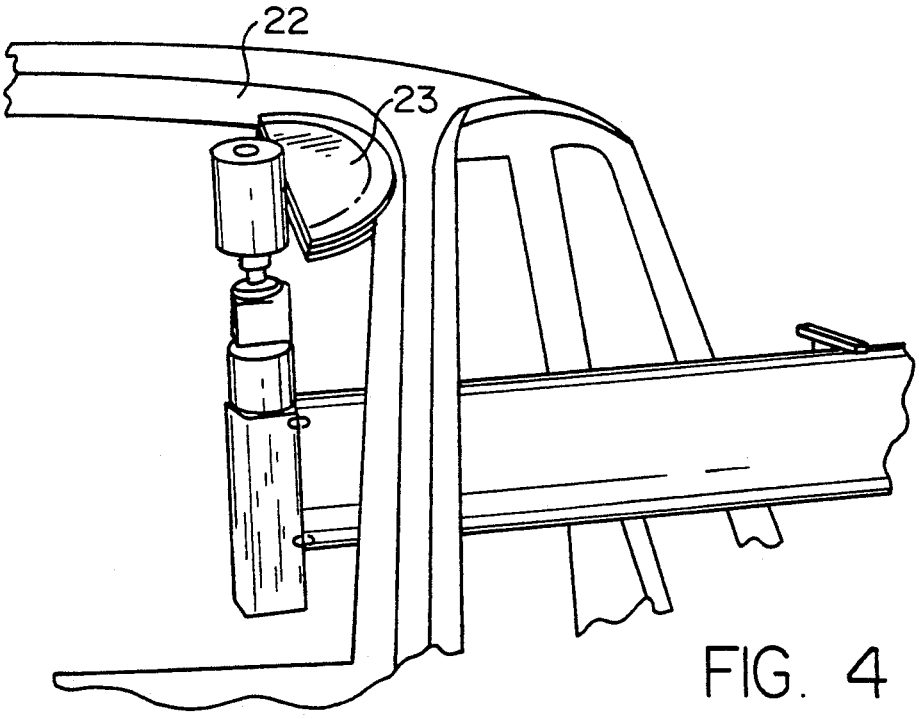
FIG. 4 illustrates the act of straightening the windshield head of a car using the straightening apparatus of the invention.
Figure 5:
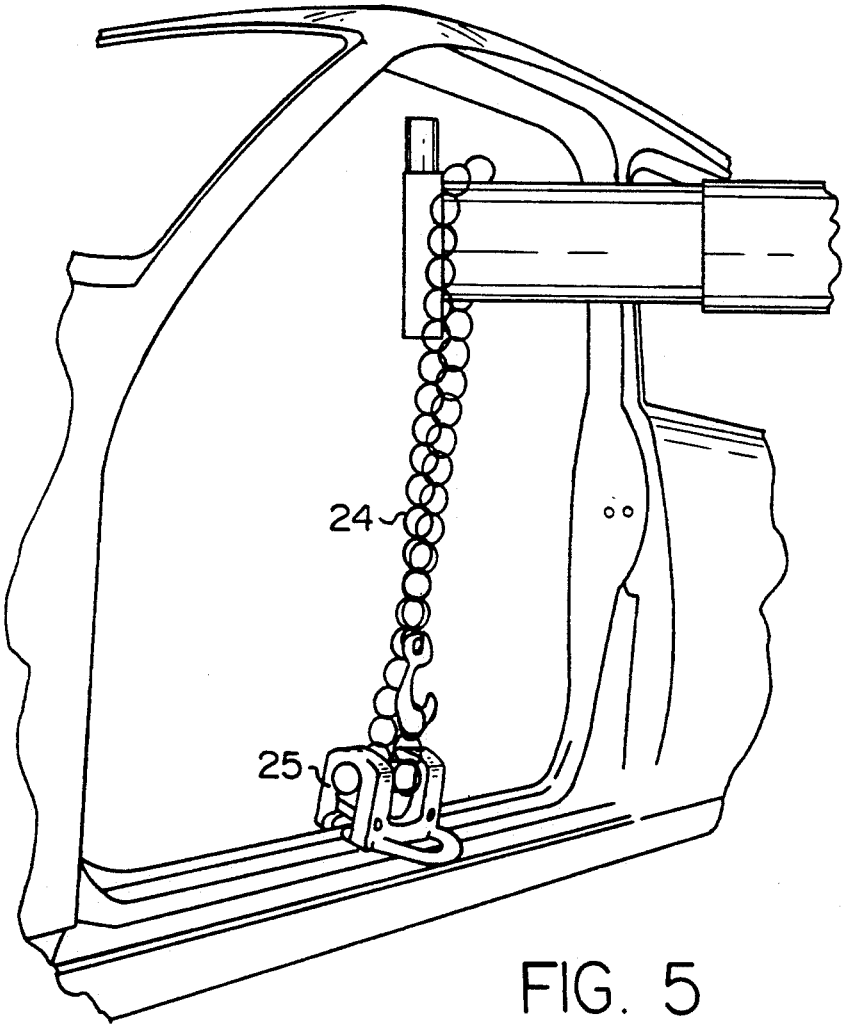
FIG. 5 illustrates the act of straightening the bottom frame of the front door of a car using the straightening apparatus of the invention.

In the arrangement of FIG. 3, the free end of the lifting beam 10 is provided with a round rubber-covered block 20, allowing the apparatus to be used for straightening the top 21 of a vehicle. In the arrangement of FIG. 4, the lifting beam end is provided with a gripping tool with jaws 23 to grip the windshield head 22, and in FIG. 5 with a chain 24 with a gripping tool with jaws 25 to allow the straightening of the bottom frame of a door.

Figure 6:
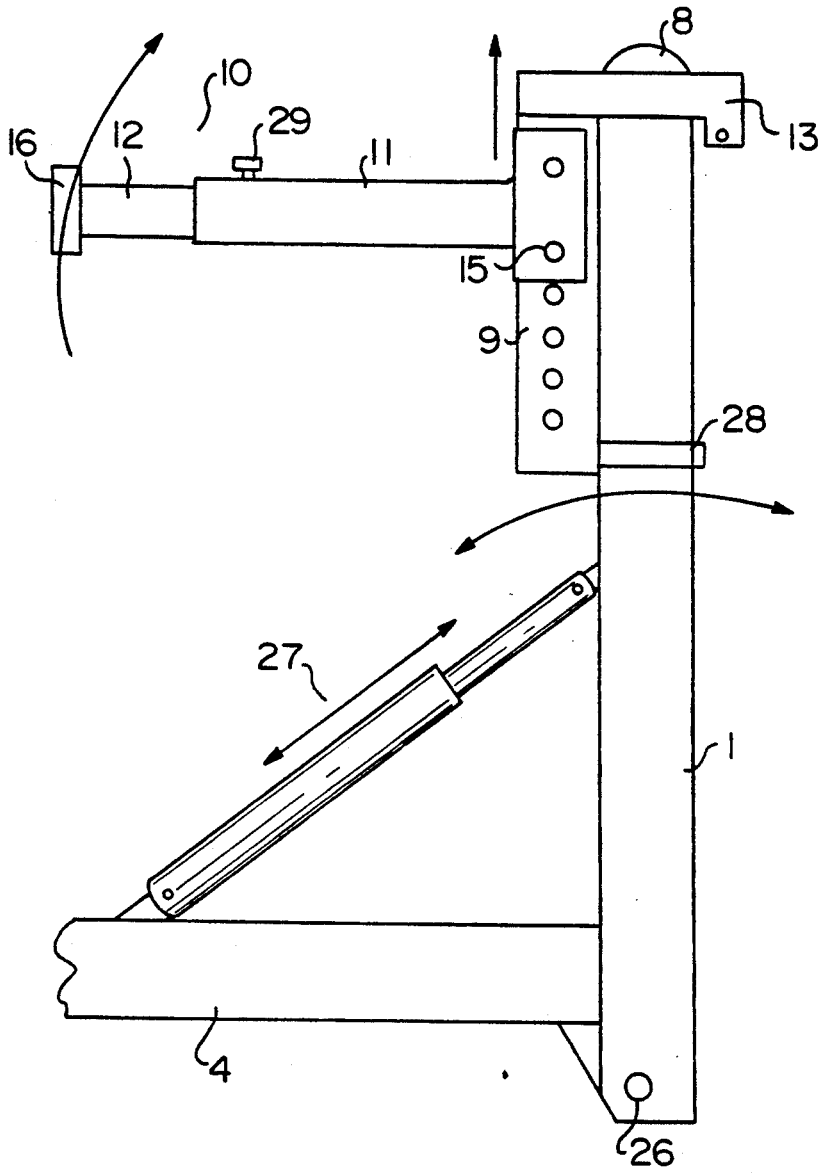
FIG. 6 presents another embodiment of the straightening apparatus of FIGS. 1*a* and 1*b* wherein a tilting connection is provided.

FIG. 6 presents a straightening apparatus provided with a joint at the lower end of the vertical beam 1 and a cylinder 27 attached to the beam and the base, for allowing the vertical beam 1 to be rotated in the direction of the lifting beam 10 as indicated by the arrows, so that the lifting beam also moves along an arched path as indicated by the arrow. To ensure that the mounting base 9 will remain securely attached to the vertical beam, its lower end can be provided with a fastening collar 28. The length setting of the lifting beam can be locked by means of an interlocking screw 29.

It is obvious to a person skilled in the art that different embodiments of the invention are not restricted to the examples described above, but that they may instead be varied within the scope of the following claims.

I claim:

1. Apparatus for the straightening of vehicles, comprising a straightening bench for the vehicle comprising a vertical beam with a cylindrical body with a piston part movable therein, wherein a mounting base is fitted to an upper end of the piston part and moves with it; wherein a lifting beam means having a lifting surface therein for producing a vertical lift required in the straightening operation is adjustably attached to the mounting base; wherein there is adjusting means for mounting the lifting beam at an adjustable height on said mounting base; and wherein there are locking means to lock the lifting beam to the mounting base in a desired horizontal position to permit straightening in a vertical, or slightly inclined from vertical, direction by vertical movement of the lifting surface on the locked horizontal lifting means caused by movement the upper piston part.

2. Straightening apparatus according to claim 1, wherein there are means to adjust the length of the lifting beam.

3. The straightening apparatus of claim 2 wherein the adjusting means allows for a stepless variation of length.

4. Straightening apparatus according to claim 2, wherein chain means are provided for the application of draw in a direction towards the vertical beam; wherein the chain means passes around a chain wheel mounted on the cylindrical body and around a top of the piston part; wherein the mounting base is provided with two flange-like edges between which the chain moves; wherein an upper end of the mounting base is formed in the shape of an inverted letter U in a plane perpendicular to the direction of draw to provide the two flange like edges and wherein a top of the piston part is fitted between said flange-like edges.

5. Straightening apparatus according to claim 1 wherein the lifting beam comprises a cylindrical body and a piston part movable therein for allowing stepless variation of the length of the lifting beam.

6. Straightening apparatus according to claim 5 wherein the lifting beam comprises a cylindrical body and a piston apart movable therein for allowing stepless variation of the length of the lifting beam.

7. Straightening apparatus according to claim 5 chain means are provided for the application of draw in a direction towards the vertical beams; wherein the chain means passes around a chain wheel mounted on the cylindrical body and around a top of the piston part; wherein the mounting base is provided with two flange-like edges between which the chain moves; wherein an upper end of the mounting base is formed in the shape of an inverted letter U in a plane perpendicular to the direction of draw to provide the two flanges like edges and wherein a top of the piston part is fitted between said flange-like edges.

8. Straightening apparatus according to claim 1 wherein the lifting beam is provided with a double-acting hydraulic cylinder-piston unit for adjusting the length of the lifting beam.

9. Straightening apparatus according to claim 8 wherein the lifting beam is provided with a double-acting hydraulic cylinder-piston unit for adjusting the length of the lifting beam.

10. Straightening apparatus according to claim 8 wherein chain means are provided for the application of draw in a direction towards the vertical beam; wherein the chain means passes around a chain wheel mounted on the cylindrical body and around a top of the piston part; wherein the mounting base is provided with two flange-like edges between which the chain moves; wherein an upper end of the mounting base is formed in the shape of an inverted letter U in a plane perpendicular to the direction of draw to provide the two flange like edges and wherein a top of the piston part is fitted between said flange-like edges.

11. Straightening apparatus according to claim 8 wherein the lifting beam is provided with straightening means (23) at a free end thereof.

12. Straightening apparatus according to claim 8 wherein chain means are provided for the application of draw in a direction towards the vertical beam; wherein the chain means passes around a chain wheel mounted on the cylindrical body and around a top of the piston part; wherein the mounting base is provided with two flange-like edges between which the chain moves; wherein an upper end of the mounting base is formed in the shape of an inverted letter U in a plane perpendicular to the direction of draw to provide the two flange like edges and wherein a top of the piston part is fitted between said flange-like edges.

13. Straightening apparatus according to claim 12 wherein the lifting beam is provided with straightening means at a free end thereof.

14. Straightening apparatus according to claim 1 wherein the lifting beam is provided with an interlocking means for holding its length at a fixed setting.

15. Straightening apparatus according to claim 1 wherein the mounting base is attached to the vertical beam by one or more fastening collars means.

16. Straightening apparatus according to claim 1 wherein the lifting beam is provided with straightening means at a free end thereof.

17. Straightening apparatus according to claim 1 wherein chain means are provided for the application of draw in a direction towards the vertical beam; wherein the chain means passes around a chain wheel mounted on the cylindrical body and around a top of the piston part; wherein the mounting base is provided with two flange-like edges between which the chain moves;

wherein an upper end of the mounting base is formed in the shape of an inverted letter U in a plane perpendicular to the direction of draw to provide the two flange like edges and wherein a top of the piston part is fitted between said flange-like edges.

18. Straightening apparatus according to claim 17 wherein chain lifting beam is provided with straightening means at a free end thereof.

* * * * *